US005138796A

United States Patent [19]

Grainger

[11] Patent Number: 5,138,796

[45] Date of Patent: Aug. 18, 1992

[54] SELF-CLOSING GATE

[76] Inventor: Dennis M. Grainger, P.O. Box 184, Butler, Mo. 64730

[21] Appl. No.: 604,187

[22] Filed: Oct. 29, 1990

[51] Int. Cl.[5] ..... E05F 1/04

[52] U.S. Cl. ..... 49/238; 49/239

[58] Field of Search ..... 49/237, 238, 239, 240, 49/236

[56] References Cited

U.S. PATENT DOCUMENTS

| | | | |
|---|---|---|---|
| 780,623 | 1/1905 | Sisk | 49/239 |
| 933,677 | 9/1909 | Smith | 49/238 X |
| 1,753,506 | 4/1930 | Florine | 49/239 X |
| 1,910,666 | 5/1933 | Babson | 49/239 X |
| 2,151,052 | 3/1939 | Smart et al. | 49/239 |
| 2,693,653 | 11/1954 | Dean, Jr. | 49/238 |
| 2,702,399 | 2/1955 | Pinion et al. | 49/239 X |
| 2,799,103 | 7/1957 | Warren | 49/237 |
| 3,222,806 | 12/1965 | Martin | 49/237 |

FOREIGN PATENT DOCUMENTS

| | | | |
|---|---|---|---|
| 18398 | 2/1930 | Australia | 49/237 |

*Primary Examiner*—Philip C. Kannan

*Attorney, Agent, or Firm*—Hovey, Williams, Timmons & Collins

[57] ABSTRACT

A self-closing gate includes a gate assembly (10) with at least one gate section (18) and a rotational mechanism (14). The rotational mechanism (14) includes structure (44) for rotatably mounting the gate section, structure (38) for storing rotational energy as the gate rotates through a predetermined rotational angle, and structure (38) for releasing the energy to cause continued rotation of the gate.

6 Claims, 2 Drawing Sheets

102
72
100
106
94
82

44
46
48
52
60
38
53
41
42
50
40

28
26
3.
3.
24
66
64
54
62
68
70

16
118
108
114
110
116

SELF-CLOSING GATE

BACKGROUND OF THE INVENTION

1. Field of the Invention

The present invention is broadly concerned with an improved self-closing gate which includes a gate assembly with at least one gate section and a rotational mechanism. More particularly, it is concerned with a gate including a mechanism for rotatably mounting the gate section, for storing rotational energy using a cam mechanism as the gate rotates through a predetermined rotational angle, and for releasing the energy to cause continued rotation of the gate.

2. Description of the Prior Art

Anyone who must pass through a gate while traveling in a vehicle such as a car, truck, tractor, or all-terrain-vehicle is familiar with the inconvenience associated with opening and closing the gate. It is necessary to stop the vehicle, dismount, open the gate, get back into the vehicle to pass through the gate, again stop the vehicle, dismount to close the gate, and again get back into the vehicle to resume travel. In inclement weather these steps may result in tracking rain, mud or snow into a closed vehicle such as a car or truck. When young children are present in the vehicle, even such brief absences of the driver may necessitate turning off the engine to avoid tampering. Animals present in the vehicle, such as dogs or cats, may run off while the vehicle is unattended.

Prior art gates provide a support post and rotating mounting and it has been possible to push such gates open with the front bumper of a truck or other vehicle. It has heretofore been necessary, however, to provide additional force to close the gate, either by manual or electrical means. The inconveniences associated with manual operation have been previously described. Electric gates are substantially more expensive to purchase and to operate and their uses are limited to locations where electrical service is available. For these reasons, such gates are not useful for all farm or ranch applications.

SUMMARY OF THE INVENTION

The present invention overcomes the problems outlined above and provides a greatly improved self-closing gate which can be operated by a driver without dismounting from a vehicle and which does not require an external source of power.

Broadly speaking, the gate includes a gate assembly and a rotational mechanism. Preferably, the rotational mechanism includes a cam mechanism for storing rotational energy as the gate rotates 90° to an open position, and for imparting the stored energy to the gate in order to induce continued rotation of the gate another 90° to a closed position.

DESCRIPTION OF THE PREFERRED EMBODIMENT

Figures 1, 6:
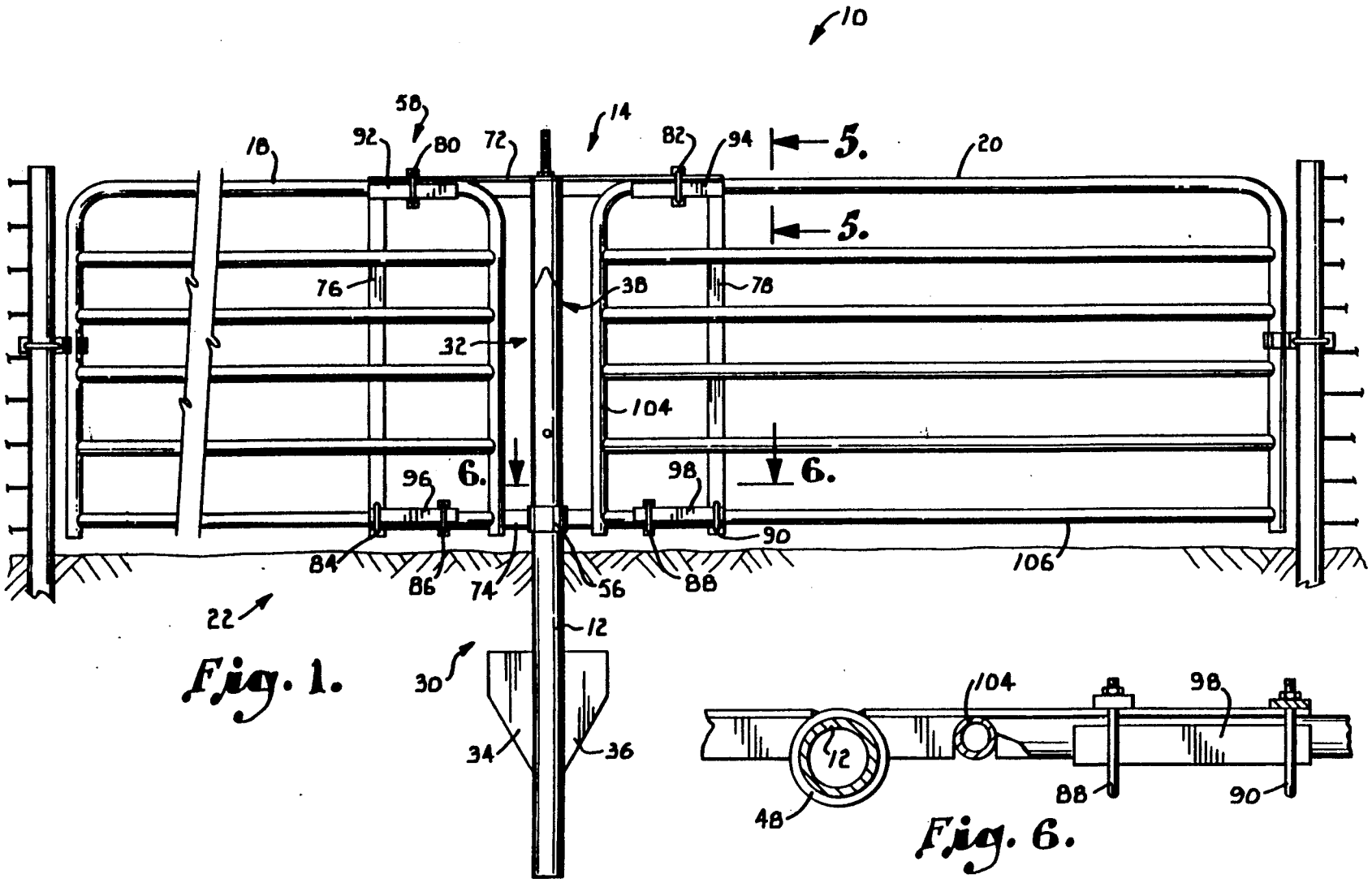
FIG. 1 is an elevational view of the preferred self-closing gate in accordance with the invention.
FIG. 6 is a sectional view taken along line 6—6 of FIG. 1.
Figures 2, 3, 4, 5:
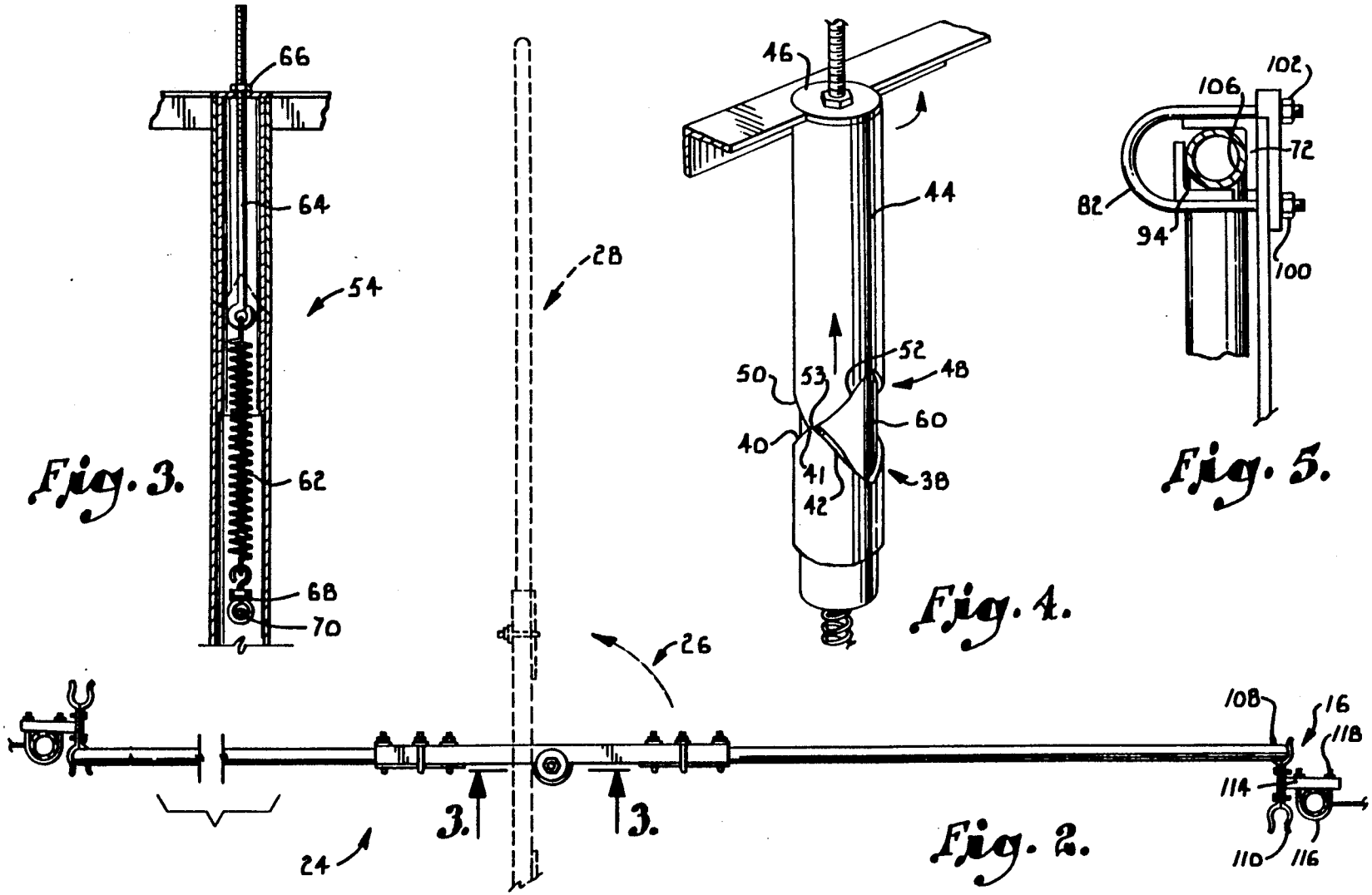
FIG. 2 is a top plan view of the gate depicted in FIG. 1, with the position after rotation of the gate sections 90° shown in phantom.
FIG. 3 is a sectional view taken along line 3—3 of FIG. 2.
FIG. 4 is a perspective view of the cam mechanism after rotation of the gate sections 90° to the open position.
FIG. 5 is a sectional view taken along line 5—5 of FIG. 1.

Referring now to the drawings, a self-closing gate is shown in FIGS. 1 and 2 to include a gate assembly 10 rotatably coupled to support member 12, rotational mechanism 14, and latch 16.

In more detail, gate assembly 10 includes first gate section 18 and second gate section 20 which together span opening 22 when in closed position as shown in FIG. 2, and which allow passage through opening 22 when rotated through angle of rotation 26 to the open position shown in phantom. The gate sections are preferably about 8 to 16 feet wide. Those skilled in the art will appreciate that the self-closing gate of the invention may be embodied using a single gate section, two gate sections in side-by-side relationship as shown, or multiple gate sections extending in spaced angular relationship from central support member 12.

Tubular support post 12 includes generally upright sections below-ground 30 and above-ground 32. A pair of flanges 34, 36 project outwardly from below-ground section 30 to provide lateral support. The support post 12 is preferably of cast iron pipe such as schedule forty with an outer diameter of about four inches to provide sufficient support for the heaviest of gate sections. Flanges 34, 36 are preferably welded or otherwise attached on opposed sides of the below ground section.

Above-ground section 32 forms a cam 38 at its upper terminus presenting engagement surfaces 40, 42 having an upwardly sloping rise of about 90° and downwardly sloping return of about 90° respectively, with rise 40 terminating in apex 41. The preferred cam profile is about 180° from the starting point at upwardly sloping engagement surface 40 to the bottom of downwardly sloping engagement surface 42, with about 90° displacement from the starting point to apex 41 which itself forms about a 90° angle.

Those skilled in the art will appreciate that the cam profile and displacement could be differently configured if greater or fewer than two gate sections were employed. For example, if a single gate section is coupled to gate mounting assembly 58, a cam profile of about 360° is preferred. Where four gate sections are coupled to gate mounting assembly 58, a cam profile of about 90° is preferred. In other preferred forms the apical angle is rounded to provide a dwell between the rise and return displacements.

As best seen in FIG. 4, rotational mechanism 14 includes tubular upper rotatable member 44, which is sealed against the elements by centrally apertured end cap 46 at its upper terminus and which forms a cam follower 48 at its lower terminus, and presenting engagement surfaces 50, 52 with the apex in between them forming knife-type edge 53. In preferred forms, rotatable member 44 is preferably of cast iron pipe such as schedule 40 with an outer diameter of about 4 inches.

The rotational mechanism further includes coupling means 54 shown in FIG. 3, tubular lower rotatable member 56 as shown in FIGS. 1 and 6, and gate mounting assembly 58. Like support post 12 and upper rotatable member 44, lower rotatable member 56 is preferably of cast iron pipe, although other materials may be used. As best seen in FIGS. 3 and 4, coupling means 54 includes tubular sleeve section 60, which is fixedly mounted coaxially inside upper rotatable member 44 and extends downwardly coaxially inside above-ground tubular support post 32. Sleeve section 60 is also preferably of cast iron pipe, such as schedule 80, with an outer diameter of about 3.5 inches to provide clearance between the outer surface of sleeve section 60 and the inner surfaces of upper rotatable member 44 and support post 12. Heavy duty coiled spring 62 is coupled in extended disposition with cap 46 by means of eye bolt 64 and nut 66 and with swivel eye hook 68 to pin 70 which extends transversly across the inner diameter of above ground support post 32. The tension of spring 62 may be adjusted by rotation of nut 66. In preferred forms, an eye bolt of about 2 feet in length and about ⅝ inch diameter is employed. Pin 70 is preferably about 0.5 inches in diameter and about 6 inches in length and is fastened against support post 12 by a pair of nuts.

While support post 12, rotatable members 44, 56 and inner sleeve 60 are preferably constructed of cast iron pipe, similar materials such as steel or in some applications, materials such as fiberglass or synthetic resins may be employed. In addition, cam and cam follower engagement surfaces 40, 41, 42, and 50, 52, 53 may be subject to a hardening process to inhibit wear.

Gate mounting assembly 58 includes upper and lower horizontal support members 72, 74, and vertical support members 76, 78. Tubular gate sections 18, 20 are sandwiched between support members 72, 74, 76, 78 and horizontal brackets 92, 94, 96, 98 as shown in FIG. 5 using U-bolts 80, 82, 84, 86, 88, 90 and pairs of nuts 100, 102. In preferred forms stock gates of about 8 to 16 feet in width are used as gate sections 18, 20. Such gate sections include an external generally rectangular shaped tubular frame with vertical and horizontal portions 104, 106, respectively. Support members are preferably of angle iron about 4 feet in length with a thickness of about ⅜ inches and are about 2.5 inches in width on each side of about a 90° angle. Brackets 92, 94, 96, 98 are preferably constructed of similar material. In embodiments employing gate sections with a tubular frame, lower horizontal support member 74 may be grooved as shown in FIG. 6 to accommodate vertical frame member 104.

Latch 16 as shown in FIG. 2 presents a pair of opposed C-shaped detent members joined by a flattened midsection 112. The latch 16 is coupled to the end section of a fence portion by a block 114 which is fixedly coupled, as by welding, to midsection 112 and which contains apertures to permit attachment of a U-bolt by a pair of nuts 118. In preferred forms, latch 16 is constructed in two longitudinal halves of resilient metal and is coupled to a steel block about 2 inches square to accommodate a U-bolt of appropriate size for attachment to the fence.

In use, a gate section 18 or 20 is pushed forwardly by the front bumper of a vehicle such as a truck or car to enable passage of the vehicle through opening 22. The momentum of the vehicle causes forward movement of the gate section in a predetermined rotational angle about the axis of support post 12. Conjoined gate mounting assembly 58 and upper member 44 including cam follower 48 rotate with the gate section in a forward direction. Cam follower surface 52 is displaced forwardly against upwardly sloping cam rise 40 causing extension of spring 62. Spring 62 prevents the follower from leaving the cam face, and also serves to store rotational and gravitational potential energy. Cam follower engagement surface 52 and edge 53 continue to ride up cam rise surface 40 until follower edge 53 meets cam apex 41 when the gate section is displaced about 90° from closed position 24.

Continued forward momentum of the gate section causes edge 53 to traverse apex 41 to the downwardly sloping surface of cam return 42. The force of gravity on the gate assembly 10 and rotational mechanism 14 and contraction of spring 62 causes follower engagement surface 52 and edge 53 to travel forwardly down cam return 42. This forward rotation displaces conjoined rotatable member 44, gate mounting assembly 58 and gate sections 18, 20.

The stored energy is thus released to induce continued rotation of the gate section an additional 90° through angle of rotation 26 until second gate section 20 is rotated a total of 180° into the location of the first gate section 18. In rotation, gate frame 104 bumps against detent member 108 which releasably retains gate assembly 10 in closed position 24 while spring 62 remains in its contracted resting state. Thus, gate assembly 10 rotates through 90° to the open position to allow vehicle passage and then automatically rotates another 90° to a second closed position which is 180° offset from the first closed position. During the next operation of gate assembly 10 gate assembly 10 again rotates another 180° and so on for each operation.

With the preferred latch 16, detent members 108, 110 are each unidirectional. That is to say, the gate assembly may travel 180° from a first closed position, through an open position, to a second closed position. Gate frame 104 may the be pushed out of detent 108, 110 by reversing the angle of rotation by which it entered the detent. The gate assembly may then be rotated 180° in reverse. The gate thus rotates back and forth, rather than continuing through a complete 360° rotation.

In other embodiments, a bidirectional latch may be employed which permits continued rotation of the gate in one direction about support post 12. In still other embodiments, as where a cattle-guard is employed, the need for a latch may be obviated.

Even without latch 16, gate assembly 10 is biased in a closed position by the cooperative action of spring 62 and gravitational force on gate assembly 10 and rotational mechanism 14.

Many variations of the preferred embodiments as described may be envisioned. For example a single gate section may be substituted for first gate section 18 and second gate section 20. Such a gate would include a cam assembly which would permit the gate section to rotate through 90° to the open position and then automatically rotate an additional 270° back to its original closed position. Alternatively, multiple gate sections may be substituted for first and second gate sections as, for example, in turnstile applications. In such applications the gate would include a cam assembly permitting each gate section to rotate through a predetermined angle to an open position, and then automatically rotate an additional predetermined angle to a closed position.

Having described the preferred embodiments of the present invention, the following is claimed as new and desired to be secured by Letters Patent:

1. A self-closing gate, comprising:

an elongated gate assembly having upper and lower horizontally extending portions, the assembly adapted in the closed position thereof to span the distance between gate opening-defining elements;

an upright support member including a lower, non-rotatable, tubular portion adapted to be rigidly mounted and presenting an upper, circumferentially extending marginal surface, and an upper, rotatable section generally axially aligned with said lower portion and presenting a lower, circumferentially extending marginal edge, the diameters of said circumferential surface and edge being substantially equal to each other and to the diameter of said lower portion;

means operatively coupling said upper, gate assembly portion with said upper rotatable section for rotation of the gate assembly with the upper section, said upper marginal surface of said lower, non-rotatable tubular portion being configured to define a cam surface integral with said lower portion, and said lower marginal edge being configured to define a cam follower surface integral with said upper portion, said cam and cam follower surfaces being cooperatively configured for, upon rotation of said upper section through a predetermined arc, biasing said upper section to a rest position corresponding to said closed position of said gate assembly;

collar means rotatably coupling said lower gate assembly portion with said lower, non-rotatable tubular portion for guiding rotation of said gate assembly circumferentially about said non-rotatable portion;

an elongated guide member extending between and spanning the juncture between said upper and lower portions and serving to guide the pivoting movement of said upper portion, and elongated spring means intercoupling said lower, non-rotatable portion with said upper, rotatable section, said spring means being coaxial with said guide member for resisting the upward movement of said rotatable portion and biasing said gate assembly toward said closed position thereof; and latch means coupled with at least one of said gate opening-defining elements for releasably latching said gate assembly in said closed position, said latch means including structure permitting latching of said gate assembly by either forward or reverse rotation of said gate assembly through said predetermined arc to said closed position.

2. The gate as set forth in claim 1, said gate assembly including a first gate section and a second gate section.

3. The gate as set forth in claim 2, said first and a second gate sections being mounted in side-by-side relationship.

4. The gate as set forth in claim 3, said gate assembly spanning an opening, said predetermined arc being about 90°, said cam and cam follower surfaces being cooperatively configured for inducing continued rotation in said direction of rotation through about an additional 90° for bringing said second gate section into the location of said first gate section, in order to re-establish said opening-spanning relationship and thereby close said gate.

5. An apparatus for use in self-closing of a gate comprising:

an upright support member including a lower, non-rotatable, tubular portion adapted to be rigidly mounted and presenting an upper, circumferentially extending marginal surface, and an upper, rotatable section adapted to be connected with said gate and generally axially aligned with said lower portion and presenting a lower, circumferentially extending marginal edge, the diameters of said circumferential surface and edge being substantially equal to each other and to the diameter of said lower portion, said upper marginal surface of said lower, non-rotatable tubular portion being configured to define a cam surface integral with said lower portion, and said lower marginal edge being configured to define a cam follower surface integral with said upper portion, said cam and cam follower surfaces being cooperatively configured for, upon rotation of said upper section through a predetermined arc, biasing said upper section to a rest position;

collar means adapted for rotatably coupling said gate with said lower, non-rotatable tubular portion for guiding rotation of said gate circumferentially about said non-rotatable portion;

an elongated guide member extending between and spanning the juncture between said upper and lower portions and serving to guide the pivoting movement of said upper portion, elongated spring means intercoupling said lower, non-rotatable portion with said upper, rotatable section, said spring means being coaxial with said guide member for resisting the upward movement of said rotatable portion and biasing said upper portion toward said rest position thereof; and latch means adapted for connection in an orientation for latching said gate in a closed position.

6. The apparatus as set forth in claim 5, further including means for coupling said gate with said upper rotatable section for rotation of the gate with the upper section.

* * * * *